United States Patent [19]

Peterson

[11] 3,956,961

[45] May 18, 1976

[54] PHASE-LOCK MULTIPLE TONE GENERATOR SYSTEM

[76] Inventor: Richard H. Peterson, 17748 Walnut Ridge Road, Palos Park, Ill. 60464

[22] Filed: June 2, 1975

[21] Appl. No.: 583,188

Related U.S. Application Data

[63] Continuation-in-part of Ser. No. 517,084, Oct. 23, 1974, abandoned.

[52] U.S. Cl. ..... 84/1.24; 84/DIG. 4; 84/DIG. 10; 331/25; 331/47

[51] Int. Cl.[2] ..... G10H 1/02; G10H 5/06

[58] Field of Search ..... 84/1.01, 1.05, 1.24, 84/1.25, DIG. 4, DIG. 10; 331/1 R, 25, 37, 47

[56] References Cited

UNITED STATES PATENTS

| | | | |
|---|---|---|---|
| 3,361,986 | 1/1968 | Catania | 331/47 X |
| 3,397,364 | 8/1968 | Crandall | 331/47 X |
| 3,611,175 | 10/1971 | Boelke | 331/25 X |
| 3,792,478 | 2/1974 | Parquier et al. | 331/25 X |
| 3,800,060 | 3/1974 | Hallman, Jr. | 84/1.24 |
| 3,828,109 | 8/1974 | Morez | 84/1.01 |
| 3,828,271 | 8/1974 | Schwanauer | 331/25 X |

*Primary Examiner*—L. T. Hix
*Assistant Examiner*—Stanley J. Witkowski
*Attorney, Agent, or Firm*—Spencer E. Olson

[57] ABSTRACT

For use in an electronic musical instrument, such as an electronic organ, a first set of tone generators, preferably of the type where all of the notes of a musical scale are obtained by frequency division from a single frequency stable master oscillator, operates together with a second set of tone generators comprised of a plurality of individually tunable chorus oscillators for generating the notes of a musical scale in a frequency range where the sensitivity of the human ear to ensemble or chorus effect is appreciable. The chorus oscillators are individually adjusted to beat with and produce chorus effects with corresponding notes derived from the first set. In addition, the entire set of chorus oscillators is capable of being simultaneously and proportionally raised or lowered in pitch by applying a control voltage to a frequency control terminal. The effect of environmental changes, such as in temperature and humidity, on the pitch of the chorus oscillators is substantially eliminated by phase comparing the signal from a selected chorus oscillator with a selected signal from the first set of tone generators which has a frequency integrally related to the frequency of selected chorus oscillator tone, and deriving a voltage proportional to the phase comparison. This voltage is applied to the voltage control terminal of each of the chorus oscillators to simultaneously and proportionally adjust their output frequencies by an amount necessary to cause the selected tone to lock in frequency with the selected tone from the first set of tone generators. Adjustment of the tuning of the single master oscillator of the first set of tone generators results in a simultaneous raising or lowering of the pitch of all of the notes of the second set of chorus oscillators.

6 Claims, 2 Drawing Figures

PHASE-LOCK MULTIPLE TONE GENERATOR SYSTEM

RELATED APPLICATION

This application is a continuation-in-part of application Ser. No. 517,084 filed Oct. 23, 1974 in the name of Richard H. Peterson and now abandoned.

BACKGROUND OF THE INVENTION

This invention relates generally to electronic musical instruments and more particularly to an improved tone generator system for such instruments.

A currently popular tone frequency oscillation generator for use in electronic organs is the system described, for example, in U.S. Pat. No. 3,236,931, known as the "top octave synthesizer" (TOS), which is driven by a stable master oscillator and is operative to generate the 12 notes in the top octave of an electronic organ, that is, from $C_7$ (4186.009 Hz) through $B_7$ (7902.133 Hz). A plurality of frequency divider chains, one for each note produced by the TOS, are used to derive the notes for the lower octaves of the instrument. An important advantage of this tone generator is its amenability to fabrication in integrated circuit form, and since all of the frequency divider chains (usually 12 in number) are of identical construction, the system is relatively easy to construct at low cost. Only one stable master oscillator is required, further contributing to reduction in cost, and since all of the tone signals generated by the system are locked together, the whole organ can be tuned by simply adjusting the master oscillator; that is, when the frequency of the master oscillator is adjusted, every note in the whole organ follows exactly. Accordingly, if the environment of the master oscillator is controlled (temperature, humidity, etc.), there is little chance of the oscillator drifting in frequency, and once properly tuned, there is little tendency for the organ to go out of tune. However, because all octaves of a given note are phase-locked, whenever notes of a given nomenclature (C-C -D, etc.) are sounded from any key on the instrument, all such notes will be dead in tune with one another.

In a live musical performance, the pleasant, exciting chorus effect comes about by reason of the use of multiple instruments; that is, a plurality of individual performers whose instruments are not always in tune with each other, but which average out in a random fashion to produce a pleasant effect. Similarly, a pipe organ is rich in chorus effects by reason of its many ranks which, due to the different effect of the environment on each cannot be kept in perfect tune with each other, but vary in random fashion to cause heating between signals of the same nominal frequency. This might suggest that chorus effects could be achieved by using two TOS tone generator systems of the kind described above, with one master oscillator tuned slightly from the other. The results of this approach have been found to be less than completely satisfactory, however, because in such a system all of the notes derived from one tone generating system are out of tune with the corresponding notes of the other system by exactly the same percentage and the result is not at all equivalent to the beating obtained from a truly random beating pattern.

One approach to obtaining a tone generator system with chorus effects is described in applicant's U.S. Pat. No. 3,538,234 wherein a full-range tone generator operates together with a second, short-range tone generator which includes only a range of frequencies over which the sensitivity of the human ear to ensemble or chorus effects is substantial, namely, in the mid-octave range. The notes from the short-range generator are each produced by an independently tunable oscillator which can be tuned away from the frequency of the corresponding note from the full-range generator by the amount necessary to achieve the desired chorus effect. Some drift in frequency between the individual oscillators can be tolerated, but since the components used in the oscillators are usually temperature sensitive, and in the interest of keeping their cost down, their environment is not controlled, there is a tendency for all of the oscillators to change in frequency with temperature sufficiently to require re-tuning to maintain the requisite frequency difference between nominally corresponding notes of the full-range and short-range generators. Moreover, should it be necessary to re-tune the full-range generator, obviously all of the individually tunable oscillators would have to be separately re-tuned to restore the proper frequency relationships between the two generators.

SUMMARY OF THE INVENTION

It is a major object of the present invention to provide a tone generating system for electronic musical instruments for providing enhanced chorus effects in which the pitch of the tones produced by independently tunable chorus oscillators can be varied within reasonable limits with a single tuning adjustment.

Another object of the invention is to provide a tone generating system having a high degree of frequency stability and wherein the whole system, including relatively unstable chorus oscillators, can be tuned by tuning a single stable oscillator while retaining the chorus effect of the chorus generators.

Briefly, these objects are attained by providing a first tone generator for producing a plurality of predetermined signal frequencies corresponding to notes of a musical scale, and a second tone generator for producing a plurality of predetermined signal frequencies corresponding to notes of a musical scale, the frequencies of the notes produced by the second tone generator being susceptible to variation with changes in environmental conditions to a different degree than the frequencies of the tones from the first tone generator vary with the same changes, and being tunable over a limited range in response to application of a control voltage. A control voltage for the second tone generator is derived by comparing the phase of a selected tone from the first tone generator with a selected tone from the second tone generator, the tone from the second tone generator being of the same nominal frequency or of an integrally related frequency, the control voltage having a polarity and amplitude depending on the degree and direction of the phase difference of the compared tones. The control voltage is applied to the second tone generator to simultaneously and proportionally adjust the frequencies thereof by an amount and in a direction, to cause locking between the selected tones.

In an illustrative embodiment, the first tone generator is a top octave synthesizer and frequency divider chain system, and the second tone generator is comprised of a plurality (for example, 32) of individually adjustable, relatively unstable oscillators, the frequency of which may be simultaneously adjusted within a limited range by a DC control signal. The control signal for the oscillators of the second tone generator is derived by comparing the phase of selected tones from the first and second generators having integrally related frequencies, so as to maintain the average stability of the whole system, in spite of the fact that the oscillators of the second tone generator may respond differently to changes in environmental conditions than the first tone generator. Thus, when the oscillators are once set to their proper frequency with their individual tuning adjustments, the whole system can be tuned by adjustment of only the single stable oscillator in the first tone generator while retaining the chorus effect of the relatively unstable oscillators in the second tone generator.

BRIEF DESCRIPTION OF THE DRAWINGS

Other objects, features and advantages of the invention, and a better understanding of its construction and operation, will be had from the following detailed description, taken in conjunction with the accompanying drawings, in which.

DETAILED DESCRIPTION OF THE INVENTION

Figure 1:
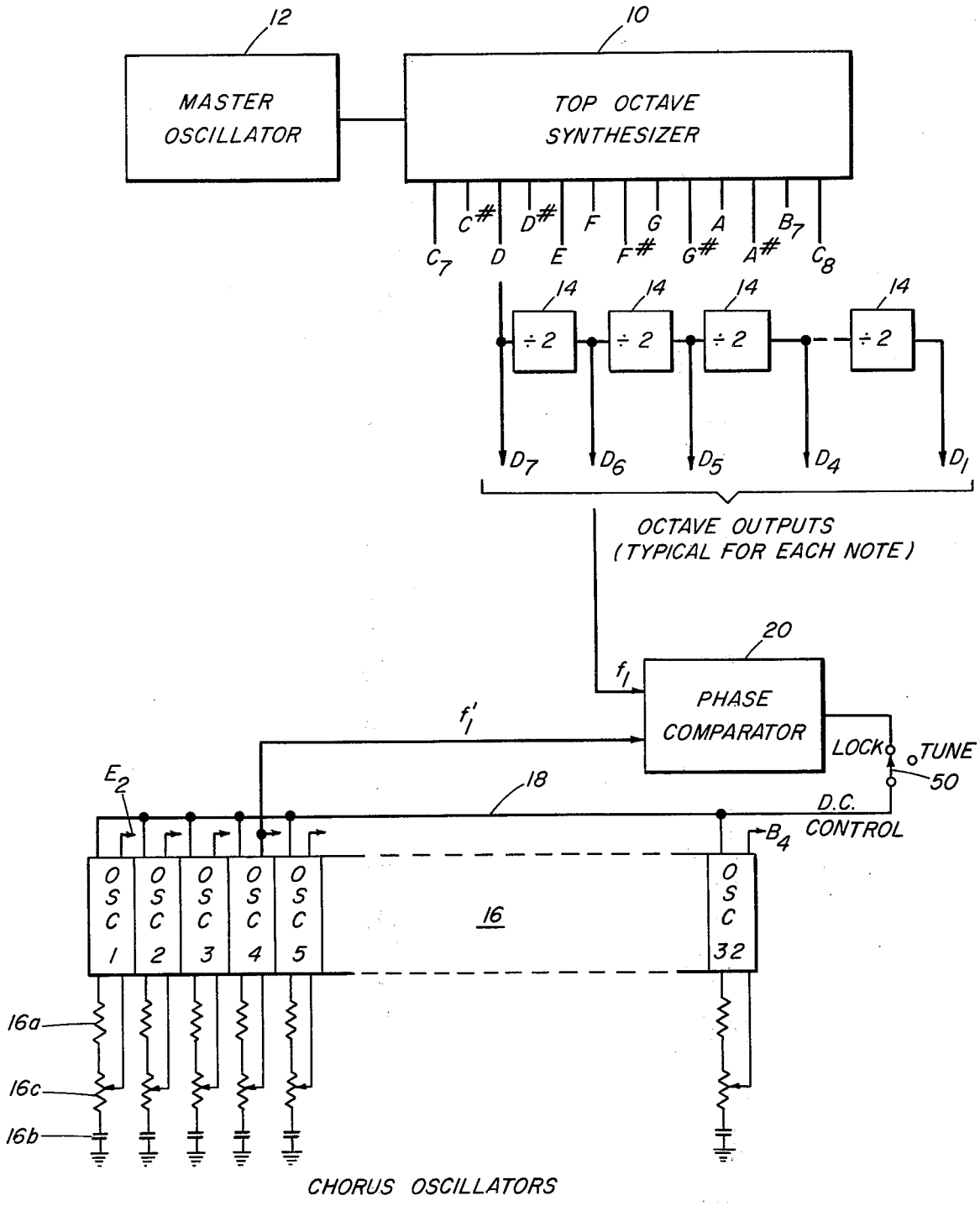
FIG. 1 is a block diagram of a tone generating system according to the invention.

Referring to FIG. 1, the system according to the invention includes the known top octave synthesizer 10 which is driven by a master oscillator 12, typically having a frequency of 2 MHz, and is operative to produce the notes in the top octave of the usual electronic organ, namely, the range from $C_7$ (4186.009 Hz) through $B_7$ (7902.133 Hz). If the utmost in frequency stability is desired, the master oscillator 12 can be crystal-controlled and placed in an enclosure the temperature and humidity of which can be closely controlled by techniques well known in the art such that the notes produced by the TOS have a high degree of stability regardless of changes in the ambient environment. Associated with each of the tone outputs of the synthesizer is a chain of frequency dividers 14 (only one of which is shown), each operative to divide the frequency of an applied signal by two, for deriving all of the octaves of a given note. Thus, to obtain seven complete octaves a chain of six frequency dividers for each of the notes from the synthesizer are required. In an electronic organ, but not shown in FIG. 1, a plurality of gating or keying circuits are associated with the tone generator for transmitting signals from the tone generator to appropriate audio channels in response to the operation of the keyboards of the musical instrument. Such audio channels, their switches, filters, etc., all of which are well known to ones skilled in the electronic organ art, form no part of the present invention and for clarity have been omitted from the drawing.

Thus far there has been described the known top octave synthesizer and frequency-divider chain type of tone generator, having limited, if any, ability to produce chorus effects, for the reasons discussed earlier. In accordance with the present invention, a plurality of chorus oscillators 16, typically 32 in number as shown and identified as OSC 1, OSC 2, OSC 3 . . . and OSC 32, respectively, are provided to generate a number of tone signals having frequencies de-tuned slightly from the corresponding 32 tones from the full-range generator. It having been determined by subjective tests that beating between signals in the low-to-middle audio region (say up to about 1,000 Hz) produces a strong illusion of chorus, while beating between signals in a substantially higher range produces little subjective "thrill" and often tends to produce an unpleasant reaction to many of the listeners, the chorus oscillators are designed to produce notes from approximately $E_2$ (164.8 Hz) through $B_4$ (987 Hz). Each of 32 notes throughout this range is produced by an independently tunable oscillator, each of which may include a resistor **16*a* and a capacitor 16*b* and the tuning of which may be accomplished by a tuning potentiometer 16*c*, as schematically illustrated in FIG. 1. Each of the oscillators is also responsive to an applied D.C. voltage to vary the frequency thereof within a limited range on either side of the nominal frequency established by the tuning adjustment 16*c*. This feature is schematically illustrated by the conductor 18 connected to each of the individual chorus oscillators; thus, as the D.C. voltage on conductor 18** is varied, the pitch of all of the oscillators are simultaneously changed from their nominal frequency. An adjustment range of ± 15% is readily attainable.

In order that the chorus effect be provided at an economical cost, the chorus oscillators are necessarily of a design that is somewhat unstable and their tuning considerably influenced by enviror mental conditions. Stated another way, it would be prohibitively expensive to use crystal-controlled oscillators and/or to control the temperature and humidity of the environment in which the oscillators are mounted in the musical instrument; instead a less expensive oscillator design, utilizing less expensive and less stable components is utilized. Fortuitously, it is a characteristic of these oscillators that when all of a plurality of them are subjected to the same environmental changes, the tuning of all tends to be affected to approximately the same degree in the same direction. In any event, if the degree of change as between any two of the individual oscillators or a group of them should not be exactly the same, such randomness may, in fact, enhance the chorus effect. It is essential, however, that the pitch of the individual chorus oscillators be maintained at values such that the difference between them and the frequency of the notes from the full-range generator with which they are to beat produce the desired chorus effect.

To this end, there is provided a phase comparator circuit 20 for comparing the pitch of a selected one of the tone signals from the stable TOS generator, designated $f_1$, with the same or integrally related pitch from one of the chorus oscillators, designated $f_1'$, to derive a variable D.C. control voltage for controlling the frequency of all of the chorus oscillators. The control voltage is applied, via conductor 18, to the voltage control terminal of each of the chorus oscillators simultaneously to adjust the frequency of all of them in accordance with the amplitude and polarity of the variable D.C. control voltage until the two selected notes lock together. Technically, when the compared tones are frequency-locked they will be in perfect tune and therefore will not produce a chorus effect, but the other 32 oscillator tones will "chorus" with the corresponding notes from the full-range tone generator. The tuning of these 32 notes can be offset by a desired amount from their corresponding full-range generator notes by the independent adjustability of the respective chorus oscillators. Thus it is seen that by using the phase comparator 20 to reference the frequency of one of the chorus oscillators to a selected tone of the same nominal or integrally related frequency from the stable oscillator, it is possible to maintain the average stability of the whole system; with this technique it is possible to "wash out" the effects of the environment on the frequency of the individual chorus oscillators.

Figure 2:
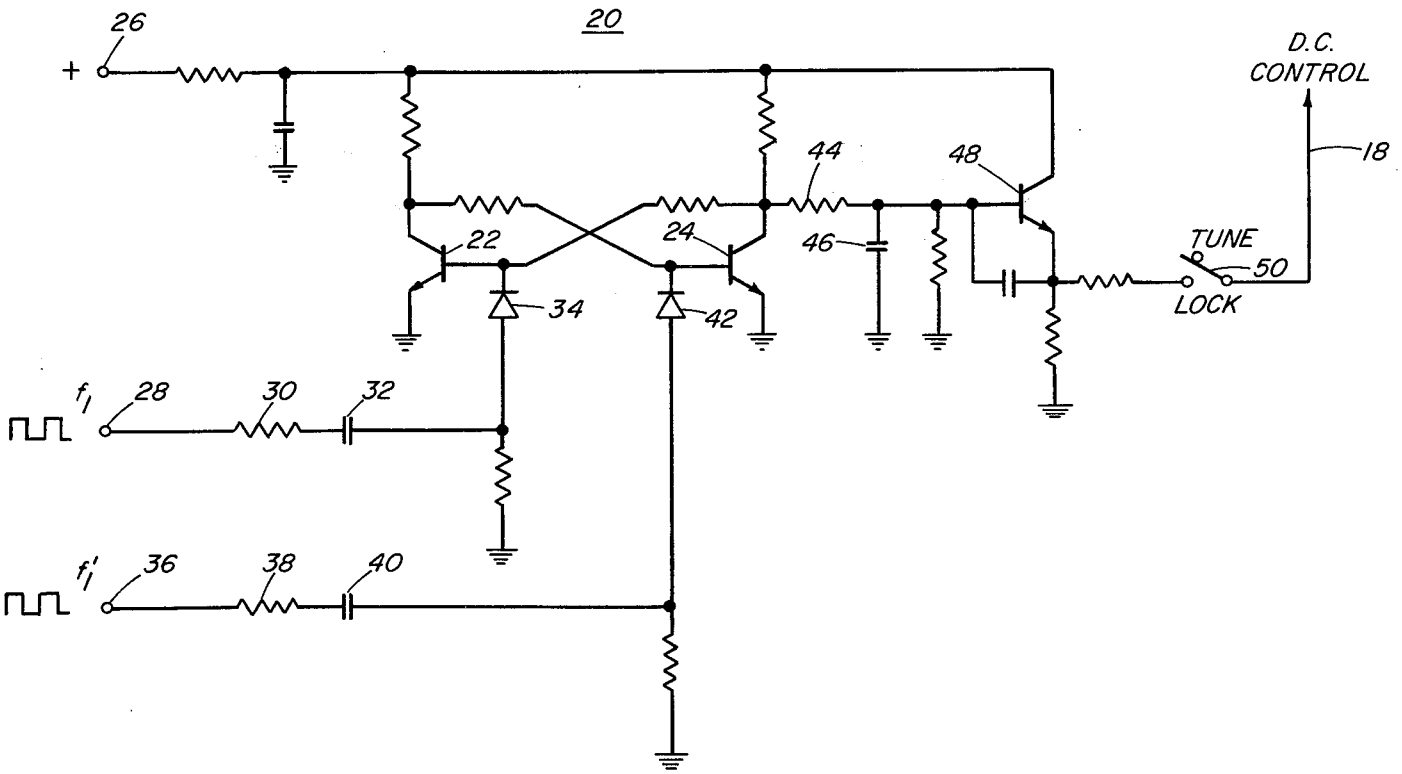
FIG. 2 is a circuit diagram of a phase comparator circuit useful in the system of FIG. 1.

A suitable phase comparator 20 for developing the D.C. control voltage, shown in schematic form in FIG. 2, includes a pair of transistors 22 and 24 connected in a direct current flip-flop arrangement with the collector electrodes of both energized from a suitable source of direct current potential, represented by the terminal 26, and their emitters connected to ground potential. Characteristic of this known circuit arrangement, one of the transistors is always saturated and the other is open. Thus, the voltage at the collector of transistor 24 will be high (i.e., at the potential at terminal 26, typically + 17 volts) when transistor 22 is conducting, or at essentially gound potential when transistor 24 is conducting. The tone $f_1$ from the full-range tone generator (indicated as having a rectangular waveform) is applied via terminal 28, resistor 30, capacitor 32 and diode 34 to the base electrode of transistor 22, and the tone $f_1'$ from one of the chorus oscillators is applied via terminal 36, resistor 38, capacitor 40 and diode 42 to the base electrode of transistor 24. Thus, one of the applied signals toggles the flip-flop one way and the other toggles the flip-flop the other way. If the frequency of $f_1$ is higher than $f_1'$, the transistor 22 will conduct more often than transistor 24, tending to increase the voltage at the collector of transistor 24. Conversely, if the frequency of $f_1'$ were higher than that of $f_1$, transistor 24 would conduct more than transistor 22 over a given period of time, tending to decrease the voltage at the collector of transistor 24. The resulting pulsating voltage at the collector of transistor 24 is smoothed by a filter consisting of resistor 44 and capacitor 46 and applied to the base electrode of a transistor 48 connected as an emitter-follower, from the emitter electrode of which the D.C. control voltage is coupled to conductor 18. A single pole-double throw switch 50 in conductor 18 when in the "lock" position applies the control voltage to the chorus oscillators to lock their respective tone outputs to the master oscillator. The switch 50 is switched to the "tune" position to enable tuning of the individual chorus oscillators.

To avoid complicating the drawings, detailed wiring of the circuitry for transmitting signals from the chorus oscillators to appropriate audio channels has not been shown, but it is to be understood that it may include the system schematically illustrated and described in the aforementioned U.S. Pat. No. 3,538,234 for transferring the signals from the full range tone generator and the signals from the chorus oscillators to a respective loudspeaker, either or both of which may be associated with a rotor, such as those shown in U.S. Pat. No. Re.23,323 to Donald J. Leslie.

It will be seen that there is provided a chorus generating system for a musical instrument whose pitch can be raised or lowered within reasonable limits with a single tuning adjustment of a stable oscillator in spite of the fact that the chorus oscillators are independently adjustable to achieve the randomness necessary to attain the desired chorus effect. It is economically feasible to accurately control the pitch of the master oscillator so that it is unaffected by environmental conditions, and the invention makes possible the use of more economical designs, which may be considerably influenced in tuning by environmental conditions, for the chorus oscillators. However, because the less stable chorus oscillators tend to be affected in approximately the same way by environmental conditions, a varying direct current voltage, derived by comparison of the phase of a tone from one of the chorus oscillators with the phase of a tone of the same nominal or integrally related frequency from the stable oscillator, can be employed to vary simultaneously the pitch of the chorus generators in the same direction and amount to maintain the desired chorus effect.

While the invention has been described as embodied in a system utilizing two separate tone generators of particular types, it will be appreciated that its advantages can be realized in a combination of more than two tone generators or with generators of types different than those specifically described. For example, the first tone generator might be of any type from which a tone can be electrically derived, with the second an electronic tone generator such as the oscillators 16. Also, although the tone generators have been described as capable of generating a specific number of notes each, obviously either generator can have any desired number of notes. Further, in the embodiment illustrated notes selected for phase comparison are of the same nominal frequency; however, as indicated, the selected notes may have nominal frequencies related as the ratio of integers without departing from the spirit of the invention.

I claim:

1. Apparatus for providing chorus effects in an electronic musical instrument, the combination comprising:

first tone generator means for producing a plurality of output tones having frequencies corresponding to the notes of a musical scale, second tone generator means for producing a plurality of output tones having frequencies corresponding to the notes of a musical scale, a selected one of which has a frequency integrally related to the frequency of a selected output tone produced by said first tone generator means, said second tone generator means being constructed such that the frequencies of its output tones vary differently with changes in environmental conditions than do the frequencies of the output tones of said first tone generator means, and being tunable in response to a control voltage to simultaneously vary the frequencies of its output tones over a limited range, phase comparator means for comparing the phase of said selected tone produced by said first tone generator means with said selected tone produced by said second tone generator means for producing a varying D.C. control voltage having a polarity and amplitude proportional to the phase difference between the compared tones, and means for applying said control voltage to said second tone generator means to simultaneously and proportionally tune the output signal frequencies thereof in accordance with the analog control voltage by an amount to cause a phase lock between the selected tones from the first and second tone generator means.

2. Apparatus according to claim 1, wherein said first tone generator means is operative to lock the frequencies of its output tones to each other and includes a single tuning control for simultaneously adjusting the frequencies of its output tones.

3. Apparatus according to claim 2, wherein said first tone generator means is of the top octave synthesizer-locked frequency divider type.

4. Apparatus according to claim 1, wherein said second tone generator means comprise a plurality of tunable oscillators, each including means for individually tuning its frequency to the frequency of a different one of said plurality of output tones, and all of which are simultaneously tunable in response to said control voltage.

5. Apparatus according to claim 4, wherein said phase comparator means has first and second inputs and wherein the selected tone from the first tone generator means is applied to the first input of the phase comparator means and the selected tone from the second tone generator means is applied to the second input of the phase comparator means, and wherein the selected tones respectively applied to the first and second inputs of the phase comparator means are of a frequency corresponding to the same note of a musical scale.

6. Apparatus for providing chorus effects in an electronic organ comprising, in combination:

first tone generator means including a master oscillator and a plurality of frequency dividers providing a plurality of output tones having frequencies corresponding to the notes of a musical scale and locked to each other, second tone generator means including a plurality of tunable oscillators, each of said oscillators including means for individually tuning its frequency to the frequency of a different one of a plurality of output tones having frequencies corresponding to the notes of a musical scale, a selected one of which has a frequency integrally related to the frequency of a selected output tone produced by said first tone generator means, said oscillators being constructed such that their frequencies are susceptible to variation with changes in environmental conditions to a different degree than the frequency of said master oscillator varies with the same changes in environmental conditions, and being simultaneously tunable in response to a control voltage, phase comparator means having first and second input terminals producing a control voltage proportional to the difference in phase between said selected one from said first tone generator means applied to the first input terminal and said selected tone from said second tone generator means applied to the second input terminal, and means for applying said control voltage to each of said tunable oscillators for forcing the frequencies of the individual tones produced thereby to be simultaneously and proportionally adjusted by an amount necessary to cause the selected tone to lock in frequency with the selected tone from said first tone generator means.

* * * * *